US011502423B2

(12) United States Patent
Lee et al.

(10) Patent No.: US 11,502,423 B2
(45) Date of Patent: Nov. 15, 2022

(54) ANTENNA APPARATUS

(71) Applicant: Samsung Electro-Mechanics Co., Ltd., Suwon-si (KR)

(72) Inventors: Woncheol Lee, Suwon-si (KR); Youngsik Hur, Suwon-si (KR); Wongi Kim, Suwon-si (KR); Jeongki Ryoo, Suwon-si (KR); Myeong Woo Han, Suwon-si (KR); Hyungjin Lee, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 0 days.

(21) Appl. No.: 17/197,470

(22) Filed: Mar. 10, 2021

(65) Prior Publication Data

US 2022/0158359 A1 May 19, 2022

(30) Foreign Application Priority Data

Nov. 19, 2020 (KR) ..... 10-2020-0155372

(51) Int. Cl.

| | |
|---|---|
| ***H01Q 21/08*** | (2006.01) |
| ***H01Q 9/04*** | (2006.01) |
| ***H01Q 21/00*** | (2006.01) |
| ***H01Q 1/52*** | (2006.01) |

(52) U.S. Cl.

CPC ..... *H01Q 21/08* (2013.01); *H01Q 1/523* (2013.01); *H01Q 1/526* (2013.01); *H01Q 9/0407* (2013.01); *H01Q 9/0485* (2013.01); *H01Q 21/0075* (2013.01)

(58) Field of Classification Search

CPC ..... H01Q 9/0407; H01Q 9/0485; H01Q 1/52; H01Q 1/521; H01Q 1/523; H01Q 21/06; H01Q 21/08

See application file for complete search history.

(56) References Cited

U.S. PATENT DOCUMENTS 5,153,600 A * 10/1992 Metzler ..... H01Q 5/40 343/846

6,384,785 B1 5/2002 Kamogawa et al.

(Continued)

FOREIGN PATENT DOCUMENTS

KR 10-0588755 B1 6/2006
KR 10-2019-0029402 A 3/2019

OTHER PUBLICATIONS

Sharma, Devendra Kumar, et al., "Shared Aperture Dual Band Dual Polarization Microstrip Patch Antenna," *Microwave and Optical Technology Letters*, 55, 4, 2013 (pp. 917-922).

(Continued)

*Primary Examiner* — Jason Crawford
(74) *Attorney, Agent, or Firm* — NSIP Law

(57) ABSTRACT

An antenna device includes a dielectric resonator antenna configured to transmit and/or receive a first RF signal, a patch antenna pattern configured to transmit and/or receive a second RF signal, and at least partially overlaps the dielectric resonator antenna in a vertical direction, a first feed via configured to feed to the dielectric resonator antenna, and a second feed via configured to feed to the patch antenna pattern, wherein a frequency of the first RF signal is lower than a frequency of the second RF signal.

28 Claims, 19 Drawing Sheets

(56) References Cited

U.S. PATENT DOCUMENTS

| | | | | |
|---|---|---|---|---|
| 8,102,330 | B1 * | 1/2012 | Albers | H01Q 5/40 343/756 |
| 9,653,808 | B2 * | 5/2017 | Hwang | H01Q 9/0457 |
| 10,637,145 | B2 * | 4/2020 | Cheng | H01Q 21/28 |
| 10,658,762 | B2 * | 5/2020 | Paulotto | H01Q 5/40 |
| 2013/0099982 | A1 * | 4/2013 | Andrenko | H01Q 9/0414 343/700 MS |
| 2015/0207233 | A1 * | 7/2015 | Kim | H01Q 9/0485 343/785 |
| 2015/0333407 | A1 * | 11/2015 | Yamagajo | H01Q 5/307 343/905 |
| 2020/0021019 | A1 * | 1/2020 | Rajagopalan | H01Q 1/2291 |
| 2020/0106158 | A1 * | 4/2020 | Gomez Angulo | G06F 1/1698 |
| 2020/0303821 | A1 * | 9/2020 | Lee | H01Q 5/335 |
| 2020/0328518 | A1 * | 10/2020 | Park | H01Q 9/0414 |
| 2020/0328530 | A1 * | 10/2020 | Park | H01Q 21/065 |
| 2021/0151889 | A1 * | 5/2021 | Han | H01Q 21/065 |
| 2021/0408687 | A1 * | 12/2021 | Lee | H01Q 5/335 |
| 2022/0013911 | A1 * | 1/2022 | Lee | H01Q 5/40 |
| 2022/0158359 | A1 * | 5/2022 | Lee | H01Q 1/241 |

OTHER PUBLICATIONS

Lai, Hau Wah et al., "An L-Probe Fed Patch Antenna Loaded with Multiple Dielectric Layers." *2015 IEEE 4th Asia-Pacific Conference on Antennas and Propagation* (*APCAP*), IEEE, 2015 (pp. 263-264).

* cited by examiner

ANTENNA APPARATUS

CROSS-REFERENCE TO RELATED APPLICATIONS

This application claims the benefit under 35 USC 119(a) of Korean Patent Application No. 10-2020-0155372 filed in the Korean Intellectual Property Office on Nov. 19, 2020, the entire disclosure of which is incorporated herein by reference for all purposes.

BACKGROUND

1. Field

The present disclosure relates to an antenna device.

2. Description of the Background

Data traffic of mobile communications is increasing rapidly every year. Active technology development is underway to support the rapidly increasing data in real-time in a wireless network. For example, applications such as making contents of Internet of Things (IoT)-based data, augmented reality (AR), virtual reality (VR), live VR/AR combined with social network service (SNS), autonomous driving, sync view (real-time image transmission from the user's perspective using an ultra-small camera), and the like require communication (e.g., 5G communication, millimeter wave (mmWave) communication, and the like) that supports transmitting and receiving large amounts of data.

Thus, recently, millimeter wave (mmWave) communication including 5G communication has been actively researched, and research for commercialization/standardization of an antenna device that smoothly implements this is also actively progressing.

An RF signal with a high frequency bandwidth (e.g., 24 GHz, 28 GHz, 36 GHz, 39 GHz, 60 GHz, and the like) is easily absorbed which leads to loss in the process of being transmitted, and thus the quality of communication may be deteriorated rapidly. Thus, an antenna for communication of the high frequency bandwidth requires a different technical approach from the existing antenna technology, and special technology development such as an additional power amplifier for securing antenna gain, integrating antenna and radio-frequency integrated circuit (RFIC), securing effective isotropic radiated power (EIRP), and the like may be required.

The above information is presented as background information only to assist with an understanding of the present disclosure. No determination has been made, and no assertion is made, as to whether any of the above might be applicable as prior art with regard to the disclosure.

SUMMARY

This Summary is provided to introduce a selection of concepts in simplified form that are further described below in the Detailed Description. This Summary is not intended to identify key features or essential features of the claimed subject matter, nor is it intended to be used as an aid in determining the scope of the claimed subject matter.

In one general aspect, an antenna device includes a dielectric resonator antenna configured to transmit and/or receive a first RF signal, a patch antenna pattern configured to transmit and/or receive a second RF signal, and at least partially overlaps the dielectric resonator antenna in a vertical direction, a first feed via configured to feed to the dielectric resonator antenna, and a second feed via configured to feed to the patch antenna pattern, wherein a frequency of the first RF signal is lower than a frequency of the second RF signal.

A dielectric constant of the dielectric resonator antenna may be higher than a dielectric constant of a dielectric layer where the patch antenna pattern is implemented.

The antenna device may further include a third feed via electrically connecting the first feed via to the dielectric resonator antenna.

The dielectric resonator antenna may include a first dielectric block, a polymer layer disposed on the first dielectric block, and a second dielectric block disposed on the polymer layer.

The antenna device may further include a metal patch disposed on the top surface of the first dielectric block, wherein the metal patch is electrically connected with the third feed via.

The antenna device may further include a strip pattern electrically connected with the first feed via, wherein the strip pattern extends in a direction that is away from the first feed via.

The antenna device may further include a plurality of shielding vias coupled to the patch antenna pattern, wherein the plurality of shielding vias are located close to the first feed via.

The plurality of shielding vias may be configure to shield the first feed via from a signal transmitted to or received from the patch antenna pattern.

The first feed via may include a 1-1 feed via configured to feed a 1-1 RF signal and a 1-2 feed via configured to feed a 1-2 RF signal, and wherein the 1-1 RF signal and the 1-2 RF signal are polarized to each other.

The second feed via may include a 2-1 feed via configured to feed a 2-1 RF signal and a 2-2 feed via configured to feed a 2-2 RF signal, and wherein the 2-1 RF signal and the 2-2 RF signal are polarized to each other.

The antenna device may further include a winding feed pattern electrically connected to an upper end of the second feed via, wherein the winding feed pattern is at least partially formed in a winding shape.

The winding feed pattern may include an extension part extended from an end of the winding feed pattern.

An antenna array may include a plurality of antenna devices including the antenna device, and a shielding structure disposed between adjacent ones of the plurality of antenna devices.

An electronic device may include the antenna device.

In another general aspect, an antenna device includes a dielectric layer having a first dielectric constant, a patch antenna pattern disposed in the dielectric layer, a dielectric resonator antenna disposed on the patch antenna pattern, the dielectric resonator antenna having a second dielectric constant, a first feed via coupled to the dielectric resonator antenna, and a second feed via coupled to the patch antenna pattern, wherein the second dielectric constant is higher than the first dielectric constant.

The patch antenna pattern may at least partially overlap the dielectric resonator antenna in a vertical direction.

An antenna array may include two or more antenna devices including the antenna device, and a shielding structure disposed between adjacent ones of the two or more antenna devices.

An electronic device may include a polygonal housing, and two or more antenna devices including the antenna device disposed adjacent to the center of each side of the polygonal housing.

In another general aspect, an antenna device includes a patch antenna pattern disposed in a dielectric layer having a first dielectric constant, a dielectric resonator antenna having a second dielectric constant and disposed on the patch antenna pattern, a first feed via coupled to the dielectric resonator antenna and extending through the patch antenna pattern, and a second feed via coupled to the patch antenna pattern.

The dielectric resonator antenna and the patch antenna pattern may overlap in a plan view.

The second dielectric constant may be higher than the first dielectric constant.

The antenna device may further include a ground layer disposed on an opposite side of the patch antenna pattern from the dielectric resonator antenna, and an integrated circuit (IC) disposed on an opposite side of the ground layer from the patch antenna pattern, wherein the IC may be configured to transmit and receive a first RF signal to and from the first feed via and a second RF signal, having a higher frequency than the first RF signal, to and from the second feed via.

An antenna array may include wo or more antenna devices including the antenna device.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative sizes, proportions, and depictions of elements in the drawings may be exaggerated for clarity, illustration, and convenience.

DETAILED DESCRIPTION

Figure 1:
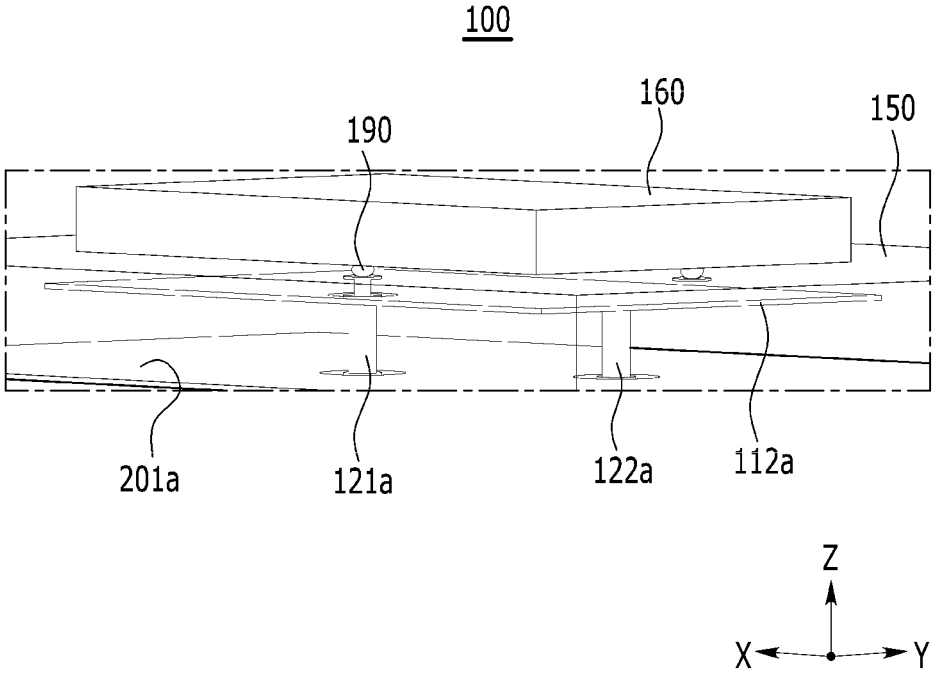
FIG. 1 and FIG. 2 are a perspective view and a side view, respectively, that schematically illustrate an antenna device according to an embodiment.

Hereinafter, while example embodiments of the present disclosure will be described in detail with reference to the accompanying drawings, it is noted that examples are not limited to the same.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of this disclosure. For example, the sequences of operations described herein are merely examples, and are not limited to those set forth herein, but may be changed as will be apparent after an understanding of this disclosure, with the exception of operations necessarily occurring in a certain order. Also, descriptions of functions and constructions that would be well known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of this disclosure.

Herein, it is noted that use of the term "may" with respect to an example or embodiment, for example, as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween. As used herein "portion" of an element may include the whole element or a part of the whole element less than the whole element.

As used herein, the term "and/or" includes any one and any combination of any two or more of the associated listed items; likewise, "at least one of" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Spatially relative terms such as "above," "upper," "below," "lower," and the like may be used herein for ease of description to describe one element's relationship to another element as illustrated in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

Due to manufacturing techniques and/or tolerances, variations of the shapes illustrated in the drawings may occur. Thus, the examples described herein are not limited to the specific shapes illustrated in the drawings, but include changes in shape that occur during manufacturing.

The features of the examples described herein may be combined in various ways as will be apparent after an understanding of this disclosure. Further, although the examples described herein have a variety of configurations, other configurations are possible as will be apparent after an understanding of this disclosure.

Throughout the specification, a pattern, a via, a plane, a line, and an electrical connection structure may include a metallic material (e.g., a conductive material such as copper (Cu), aluminum (Al), silver (Ag), tin (Sn), gold (Au), nickel (Ni), lead (Pb), titanium (Ti), or an alloy thereof), and may be formed according to a plating method such as chemical vapor deposition (CVD), physical vapor deposition (PVD), sputtering, a subtractive process, an additive process, a semi-additive process (SAP), a modified semi-additive process (MSAP), and the like, but this is not restrictive.

Throughout the specification, a dielectric layer and/or an insulation layer may be implemented with a thermosetting resin such as FR4, a liquid crystal polymer (LCP), lower temperature co-fired ceramic (LTCC), an epoxy resin, and the like, a thermoplastic resin such as polyimide, or a resin formed by impregnating the thermosetting resin and the thermoplastic resin in core materials such as glass fiber (glass fiber, glass cloth, glass fabric) with an inorganic filler, a prepreg, an Ajinomoto build-up film (ABF), FR4, bismaleimide triazine (BT), a photoimageable dielectric (PID) resin, a typical copper clad laminate (CCL), or a class or ceramic-based insulation material.

Throughout the specification, an RF signal includes Wi-Fi (IEEE 802.11 family, etc.), WiMAX (IEEE 802.16 family, etc.), IEEE 802.20, LTE (long term evolution), Ev-DO, HSPA, HSDPA, HSUPA, EDGE, GSM, GPS, GPRS, CDMA, TDMA, DECT, Bluetooth, 3G, 4G, 5G, and any other wireless and wired protocols designated thereafter, but is not limited thereto.

Example embodiments described herein provide an antenna device that may be easily down-sized while providing transmitting or receiving for a plurality of frequency bandwidths that are different from each other.

Example embodiments described herein may improve a gain of an antenna while assuring a wide bandwidth of the antenna.

Example embodiments described herein provide an antenna device that may improve gains of a plurality of frequency bandwidths that are different from each other by improving the degree of isolation between the plurality of different frequency bandwidths.

Hereinafter, an antenna device according to an embodiment will be described in detail with reference to the accompanying drawings.

Figure 2:
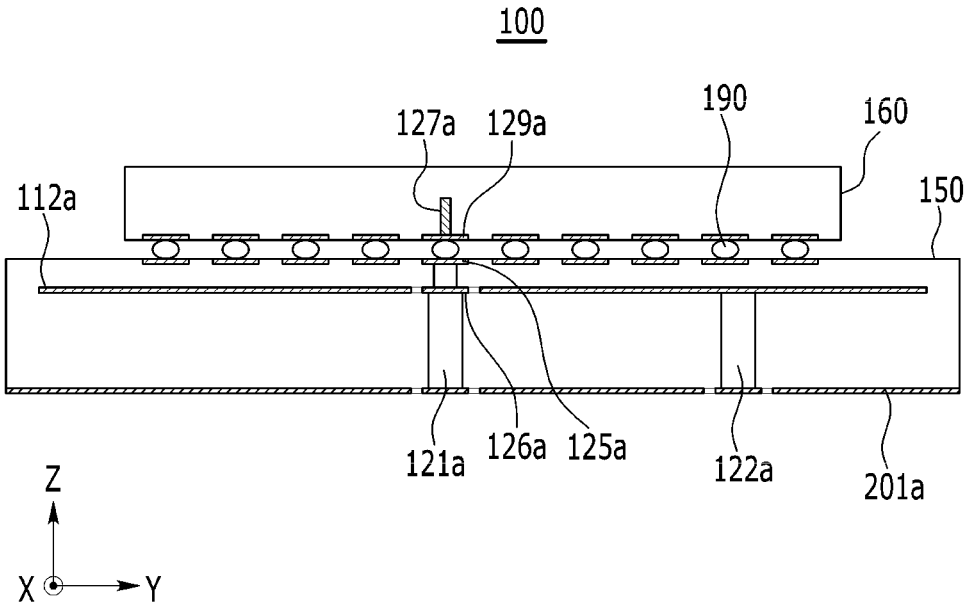

FIG. 1 and FIG. 2 are a perspective view and a side view, respectively, that schematically illustrate an antenna device according to an embodiment.

Referring to FIG. 1 and FIG. 2, an antenna device 100 may transmit or receive a plurality of frequency bandwidths, each different from one another, by including a dielectric resonator antenna 160 and a patch antenna pattern 112*a*.

The antenna device 100 includes a first feed via 121*a* and a second feed via 122*a*. The first feed via 121*a* may provide direct feeding to the dielectric resonator antenna 160 or indirect feeding by coupling feeding, and the second feed via 122*a* may provide direct feeding to the patch antenna pattern 112*a* or indirect feeding by coupling feeding. The antenna device 100 may selectively include a third feed via 127*a*. The third feed via 127*a* electrically connects the first feed via 121*a* and the dielectric resonator antenna 160, and is inserted into the dielectric resonator antenna 160. In addition, the third feed via 127*a* may be located at an outer surface of the dielectric resonator antenna 160. The dielectric resonator antenna 160 may be fed through the first feed via 121*a* and the third feed via 127*a*, and accordingly, feeding efficiency can be improved.

The dielectric resonator antenna 160 may radiate an electromagnetic wave by generating a resonance mode in a dielectric material through feeding. When the dielectric resonator antenna 160 is in air, a side surface of the dielectric resonator antenna 160 may be formed to contact the air. The dielectric resonator antenna 160 may be made of a ceramic material or a dielectric material with a dielectric constant greater than 1. A resonant frequency of the dielectric resonator antenna 160 may be determined based on the volume and dielectric constant. Accordingly, it is possible to downsize the antenna device 100 by utilizing the dielectric constant and area of the material that forms the dielectric resonator antenna 160.

The dielectric resonator antenna 160 may be provided with a first RF signal of a first frequency bandwidth (e.g., 28 GHz) and transmit the first RF signal, or may receive a first RF signal and provide the received first RF signal to the first feed via 121*a*.

The patch antenna pattern 112*a* may be provided with a second RF signal of a second frequency bandwidth (e.g., 39 GHz) and transmit the second RF signal, or may receive a second RF signal and provide the received second RF signal to the second feed via 122*a*. The frequency of the second RF signal may be higher than the frequency of the first RF signal.

The dielectric resonator antenna 160 and the patch antenna pattern 112*a* respectively resonate with respect to first and second frequency bandwidths, and intensively accommodate energy corresponding to the first and second signals and radiate to the outside.

In addition, the antenna device 100 may include a ground plane 201*a*. Since the ground plane 201*a* can reflect first and second RF signals that are radiated toward the ground plane 201*a* among the first and second RF signals radiated from the dielectric resonator antenna 160 and the patch antenna pattern 112*a*, radiation patterns of the dielectric resonator antenna 160 and the patch antenna pattern 112*a* can be concentrated in a specific direction (e.g., z-axis direction). Accordingly, the gains of the dielectric resonator antenna 160 and the patch antenna pattern 112*a* may be improved.

Resonance of the dielectric resonator antenna 160 and the patch antenna pattern 112*a* can be generated based on a resonance frequency according to a combination of inductance and capacitance corresponding to the dielectric resonator antenna 160, the patch antenna pattern 112*a*, and a peripheral structure.

A size of the top surface and/or bottom surface of each of the dielectric resonator antenna 160 and the patch antenna pattern 112*a* may affect the resonance frequency. For example, the size of the top surface and/or bottom surface of each of the dielectric resonator antenna 160 and the patch antenna pattern 112*a* may be dependent on a first wavelength and a second wavelength that respectively correspond to the radiated first and second RF signals.

At least some of the dielectric resonator antenna 160 and at least some of the patch antenna pattern 112*a* overlap in a vertical direction (e.g., z-axis direction). Accordingly, the size of the antenna device 100 may be significantly reduced in a horizontal direction (e.g., x-axis direction and/or y-axis direction), and thus the antenna device 100 can be easily down-sized overall.

A dielectric constant of a dielectric material that forms the dielectric resonator antenna 160 is higher than a dielectric constant of a dielectric layer 150 where the patch antenna pattern 112*a* is implemented. Accordingly, due to the dielectric resonator antenna 160 having a relatively high dielectric constant, an electrical length of the dielectric resonator antenna 160 may be shortened such that the size of the entire antenna device 100 can be reduced. In addition, the resonance frequency of the dielectric resonator antenna 160 is determined based on the dielectric constant and the volume, and thus the size of the entire antenna device 100 can be further reduced by adjusting the volume of the dielectric resonator antenna 160, and the degree of freedom of design of the antenna device 100 can be increased.

The dielectric resonator antenna 160 has a single-layered structure or a multi-layered structure. When the dielectric resonator antenna 160 has a multi-layered structure, the bandwidth of the dielectric resonator antenna 160 may be sufficiently secured. For example, since there is a limitation to increasing the thickness of a single layer, when a plurality of layers are used, a distance between the dielectric resonator antenna 160 and the ground plane 201*a* increases and thus the bandwidth may be extended. In addition, in a multi-layered structure, when the dielectric resonator antenna 160 is indirectly fed by coupling feeding, a single resonance is formed in the dielectric resonator antenna 160, thereby extending the bandwidth and increasing the design freedom.

The dielectric layer 150 where the patch antenna pattern 112*a* is implemented has a single-layered structure or a multi-layered structure. When the dielectric layer 150 has a multi-layered structure, the bandwidth of the patch antenna pattern 112*a* can be more sufficiently assured. For example, since there is a limitation to increasing the thickness of a single layer, when a plurality of layers are used, a distance between the patch antenna pattern 112*a* and the ground plane 201*a* increases and thus the bandwidth may be extended. In addition, in a multi-layered structure, when the patch antenna pattern 112*a* is indirectly fed by coupling feeding, a single resonance is formed in the patch antenna pattern 112*a*, thereby extending the bandwidth and increasing the design freedom.

The dielectric resonator antenna 160 and the first feed via 121*a* may be connected with an electrical connection structure 190. For example, the electrical connection structure 190 may have a structure such as a solder ball, a pin, a land, a pad, and the like.

The first feed via 121*a* and the second feed via 122*a* are disposed to penetrate at least one through-hole of the ground plane 201*a*. Accordingly, one end of each of the first feed via 121*a* and the second feed via 122*a* is disposed in an upper side of the ground plane 201*a*, and the other end of each of the first feed via 121*a* and the second feed via 122*a* is disposed in a lower side of the ground plane 201*a*. Here, the other ends of the first feed via 121*a* and the second feed via 122*a* are connected to an integrated circuit (IC), and thus they may provide the first RF signal and the second RF signal to the IC or may be provided with the signals from the IC. A first RF signal and a second RF signal that are radiated toward the ground plane 201*a* among the first RF signals and the second RF signals radiated from the dielectric resonator antenna 160 and the patch antenna pattern 112*a* are reflected by the ground plane 201*a*, and therefore electromagnetic isolation between the dielectric resonator antenna 160, the patch antenna pattern 112*a*, and the IC can be improved by the ground plane 201*a*. Accordingly, radiation patterns of the dielectric resonator antenna 160 and the patch antenna pattern 112*a* can be concentrated in a specific direction (e.g., z-axis direction) such that the gains of the dielectric resonator antenna 160 and the patch antenna pattern 112*a* can be improved.

In the antenna device 100, the dielectric resonator antenna 160 and the patch antenna pattern 112*a* are respectively electrically connected with the IC in the vertical direction (e.g., z-axis direction) through the first feed via 121*a* and the second feed via 122*a*. Accordingly, since a length in the vertical direction (e.g., z-axis direction) between the dielectric resonator antenna 160, the patch antenna pattern 112*a*, and the IC is relatively short, the first and second feed vias 121*a* and 122*a* can easily reduce the electrical distance between the dielectric resonator antenna 160 and the patch antenna pattern 112*a*, and the IC. Since the electrical distance from the dielectric resonator antenna 160 and the patch antenna pattern 112*a* to the IC is short, the loss of transmission energy in the antenna device 100 of the first and second RF signals may be reduced, and thus the gain of the antenna device 100 may be improved.

In addition, when at least some of the dielectric resonator antenna 160 and at least some of the patch antenna pattern 112*a* overlap, the first feed via 121*a* may be disposed to penetrate through the patch antenna pattern 112*a* for electrical connection with the dielectric resonator antenna 160.

Accordingly, the transmission energy loss of the first and second RF signals in the antenna device 100 may be reduced, and connection points of the first and second feed vias 121*a* and 122*a* in the dielectric resonator antenna 160 and the patch antenna pattern 112*a* can be more freely designed.

Here, the connection points of the first and second feed via 121*a* and 122*a* may affect transmission line impedance in terms of the first and second RF signals. The transmission line impedance can reduce a reflection phenomenon during a process for providing the first and second RF signals to be closely matched to a specific impedance (e.g., 50 ohms), and when the design freedom of the connection points of the first and second feed vias 121*a* and 122*a* is high, the gains of the dielectric resonator antenna 160 and the patch antenna pattern 112*a* can be improved more easily.

Support patterns 125*a*, 126*a*, and 129*a* may be selectively disposed in the dielectric layer 150 and the dielectric resonator antenna 160. The support patterns 125*a*, 126*a*, and 129*a* are formed of metals and contact the electrical connection structure 190, and thus the dielectric layer 150 and the dielectric resonator antenna 160 can be rigidly bonded to the electrical connection structure 190. In addition, the support patterns 125*a*, 126*a*, and 129*a* may have wider widths than a width of the first feed via 121*a* or a width of the electrical connection structure 190. In manufacturing of a multi-layered PCB, a process error, such as disconnection, may occur. However, the support patterns 125*a*, 126*a*, and 129*a* have wider widths than the first feed via 121*a* or the electrical connection structure 190, and thus occurrence of disconnection in the manufacturing of the multi-layered PCB can be prevented. However, the support patterns 125*a*, 126*a*, and 129*a* can be omitted depending on designs.

Figure 3A:
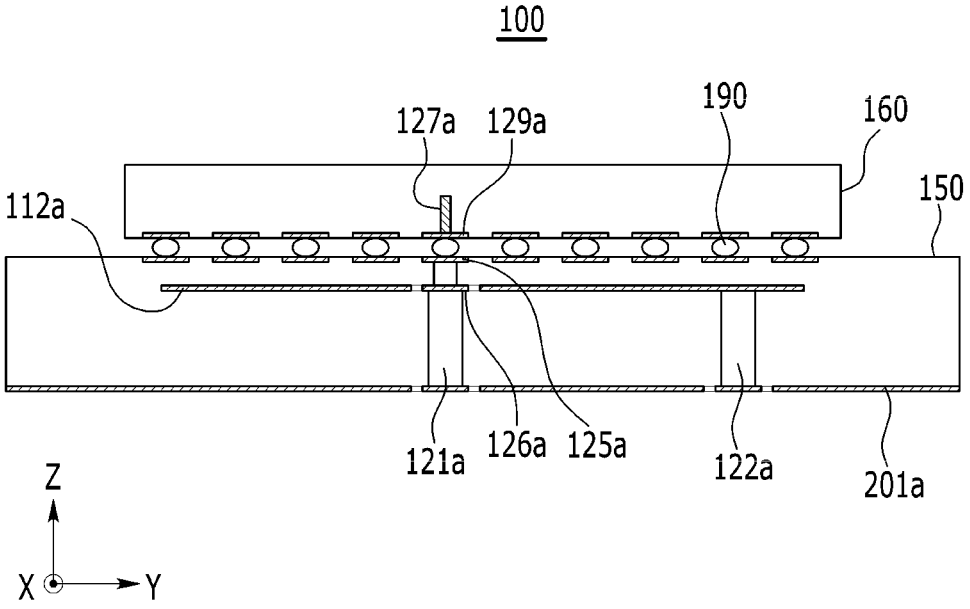
FIG. 3A is a side view that schematically illustrates an antenna device according to an embodiment.

FIG. 3A is a side view that schematically illustrates an antenna device according to an embodiment.

Referring to FIG. 3A, an antenna device 100 includes a dielectric resonator antenna 160, a patch antenna pattern 112*a*, a first feed via 121*a*, and a second feed via 122*a*. The antenna device 100 may selectively include a ground plane 201*a*, and may selectively include an electrical connection structure 190. Among the configurations of the antenna device 100 of FIG. 3A, the above-stated description of the antenna device 100 of FIG. 1 and FIG. 2 is applied to the configurations overlapping with the antenna device 100 of FIG. 1 and FIG. 2.

At least some of the patch antenna pattern 112*a* overlaps the dielectric resonator antenna 160 in a vertical direction, and a flat area of the patch antenna pattern 112*a* may be smaller than a flat area of the dielectric resonator antenna 160. Accordingly, the entire size of the antenna device 100 is reduced, thereby enabling down-sizing of the antenna device 100.

Figure 3B:
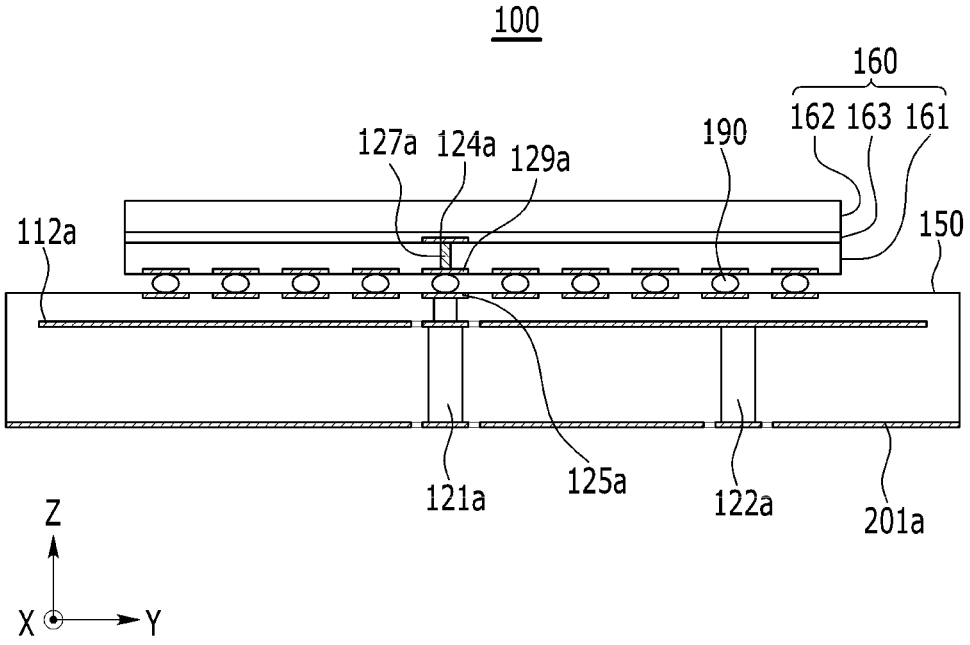
FIG. 3B is a schematic side view of an antenna device according to an embodiment.

FIG. 3B is a schematic side view of an antenna device according to an embodiment.

Referring to FIG. 3B, an antenna device 100 includes a dielectric resonator antenna 160, a patch antenna pattern 112*a*, a first feed via 121*a*, and a second feed via 122*a*. The antenna device 100 may selectively include a ground plane 201*a*, and may selectively include an electrical connection structure 190. Among the configurations of the antenna device 100 of FIG. 3B, the above-stated description of the antenna device 100 of FIG. 1 and FIG. 2 is applied to the configurations overlapping with the antenna device 100 of FIG. 1 and FIG. 2.

The dielectric resonator antenna 160 includes a first dielectric block 161, a polymer layer 163 disposed on the first dielectric block 161, and a second dielectric block 162 disposed on the polymer layer 163. Due to such a structure of the dielectric resonator antenna 160, a bandwidth may be expanded and a gain can be improved. For example, when only the first dielectric block 161 is present, a single resonance may be generated near about 35 GHz, and the peak gain at a boresight may be about 2 dB. However, in case of the dielectric resonator antenna 160 of FIG. 3, a double resonance may be generated near about 27 GHz and near about 31 GHz, and the peak gain at the boresight may be about 5 dB.

The first dielectric material block 161 and the second dielectric material block 162 may respectively have rectangular shapes of the same planar shapes, and may be at least partially overlapped with each other in a planar view.

The first dielectric block 161 and the second dielectric block 162 may radiate electromagnetic waves by generating resonance modes through feeding, respectively. When the dielectric resonator antenna 160 is in air, a side surface of each of the first dielectric block 161 and the second dielectric block 162 may be formed to contact the air.

The first dielectric block 161 and the second dielectric block 162 may each be made of a ceramic material or a dielectric material with a dielectric constant greater than 1. A resonant frequency of each of the first dielectric block 161 and the second dielectric block 162 may be determined based on the volume and dielectric constant. Accordingly, it is possible to down-size the antenna device 100 by utilizing the dielectric constants and areas of the materials that form the first dielectric block 161 and the second dielectric block 162, respectively. The dielectric constants of the first dielectric block 161 and the second dielectric block 162 may be the same as or different from each other.

The polymer layer 163 is disposed between the first dielectric material block 161 and the second dielectric material block 162, and may bond the dielectric material blocks. The polymer layer 163 may include at least one of a polyimide-based polymer, a poly(methyl methacrylate)-based polymer, a polytetrafluoroethylene-based polymer, a polyphenylene ether-based polymer, a benzocyclobutene-based polymer, and a liquid crystal polymer. A dielectric constant of the polymer layer 163 may be smaller than that of the first dielectric material block 161 and may be smaller than that of the second dielectric material block 162.

The antenna device 100 may selectively include a third feed via 127*a*. The third feed via 127*a* electrically connects the first feed via 121*a* and the first dielectric block 161, and may be located in the first dielectric block 161. In addition, the third feed via 127*a* may be located at an outer surface of the first dielectric block 161. The first dielectric block 161 and the second dielectric block 162 may be fed through the first feed via 121*a* and the third feed via 127*a*, and accordingly, feeding efficiency can be improved.

The antenna device 100 may selectively include a metal patch 124*a* that is disposed on the top surface of the first dielectric block 161. The metal patch 124*a* is disposed in the bottom surface of the polymer layer 163. The metal patch 124*a* is electrically connected with the third feed via 127*a*, and accordingly, feeding efficiency can be further improved. The metal patch 124*a* may have planes of various shapes such as polygons and circles in various sizes. By changing the size and shape of the metal patch 124*a*, the design freedom of the antenna device 100 can be improved by combining it with the first feed via 121*a* and the third feed via 127*a*.

Figure 3C:
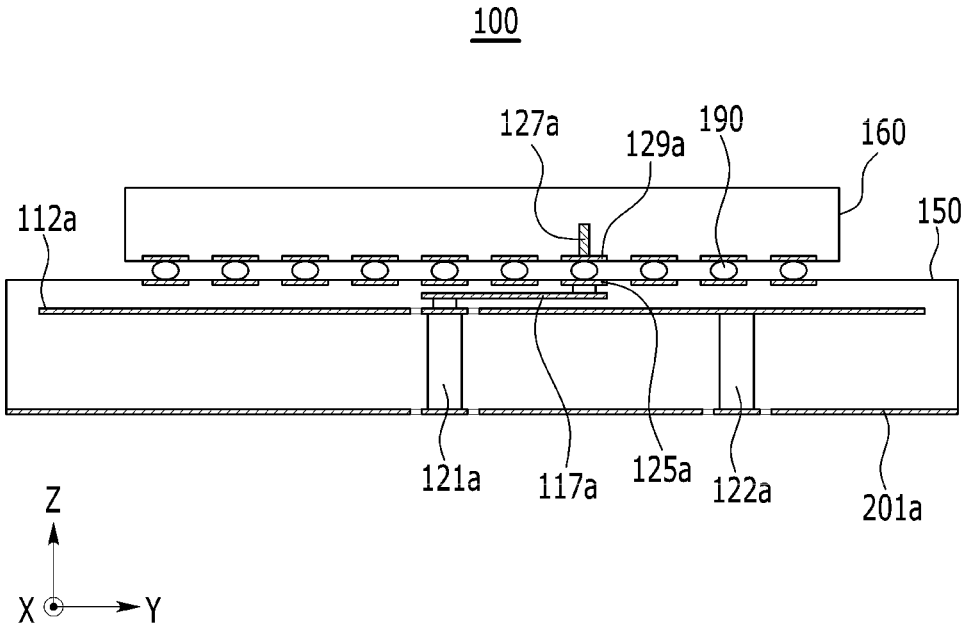
FIG. 3C is a schematic side view of an antenna device according to an embodiment.

FIG. 3C is a schematic side view of an antenna device according to an embodiment.

Referring to FIG. 3C, an antenna device 100 includes a dielectric resonator antenna 160, a patch antenna pattern 112*a*, a first feed via 121*a*, and a second feed via 122*a*. The antenna device 100 may selectively include a third feed via 127*a*, a ground plane 201*a*, and an electrical connection structure 190. Among the configurations of the antenna device 100 of FIG. 3C, the above-stated description of the antenna device 100 of FIG. 1 and FIG. 2 is applied to the configurations overlapping with the antenna device 100 of FIG. 1 and FIG. 2.

The antenna device 100 includes a strip pattern 117*a*. The strip pattern 117*a* extends in a direction that is away from the first feed via 121*a*, and electrically connects the first feed via 121*a* and the third feed via 127*a*. The strip pattern 117*a* may have a plane parallel to a plane of the patch antenna pattern 112*a*. Electrical strength of a feeding path for the dielectric resonator antenna 160 may be adjusted through the strip pattern 117*a*, and accordingly, the degree of freedom of impedance matching can be increased, and the gain of the antenna device 100 can be improved.

Figure 4:
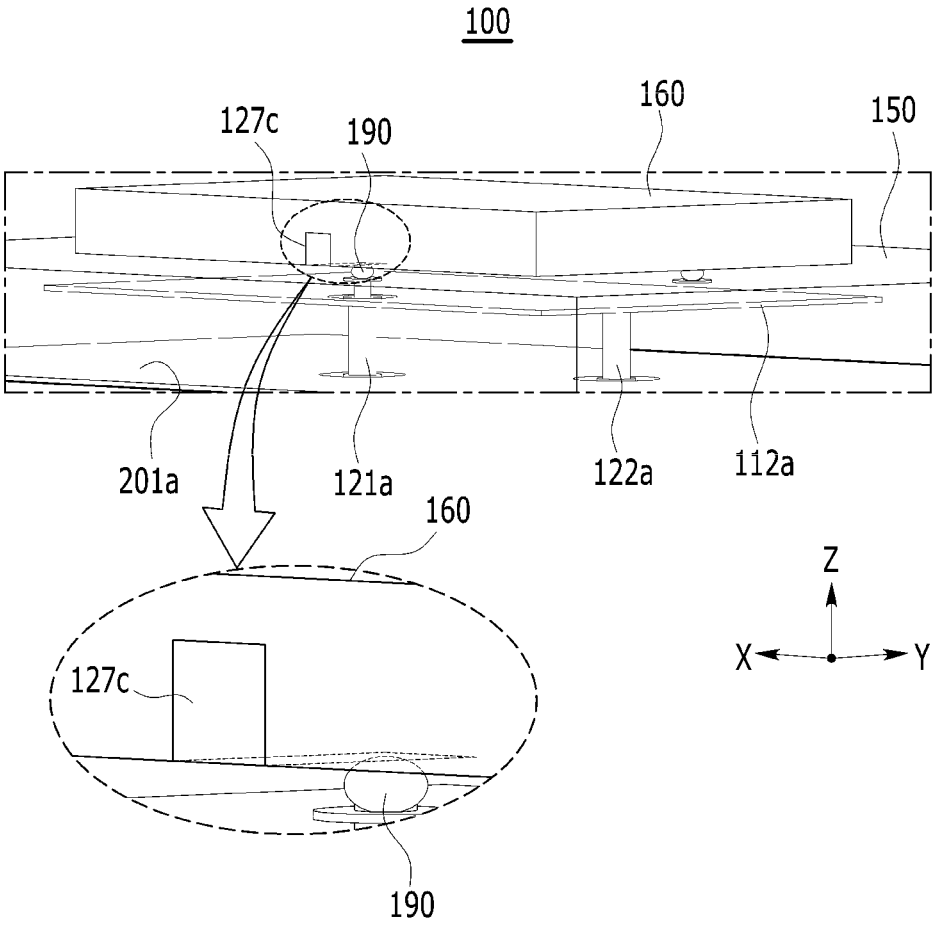
FIG. 4 is a schematic perspective view of an antenna device according to an embodiment.

FIG. 4 is a schematic perspective view of an antenna device according to an embodiment.

Referring to FIG. 4, an antenna device 100 includes a dielectric resonator antenna 160, a patch antenna pattern 112*a*, a first feed via 121*a*, and a second feed via 122*a*. The antenna device 100 may selectively include a ground plane 201*a*, and may selectively include an electrical connection structure 190. Among the configurations of the antenna device 100 of FIG. 4, the above-stated description of the antenna device 100 of FIG. 1 and FIG. 2 is applied to the configurations overlapping with the antenna device 100 of FIG. 1 and FIG. 2.

The antenna device 100 includes a feeding pattern 127*c* that is disposed at an outer surface of the dielectric resonator antenna 160. The feeding pattern 127*c* is disposed at an outer side surface and the bottom surface of the dielectric resonator antenna 160, and is electrically connected with the electrical connection structure 190. The feeding pattern 127*c* is electrically connected with the first feed via 121*a* by the electrical connection structure 190, and provides a feeding path to the dielectric resonator antenna 160. An electrical length of the feeding pattern 127*c* can be adjusted, and accordingly, the degree of freedom of impedance matching can be increased, and the gain of the antenna device 100 can be improved.

Figure 5:
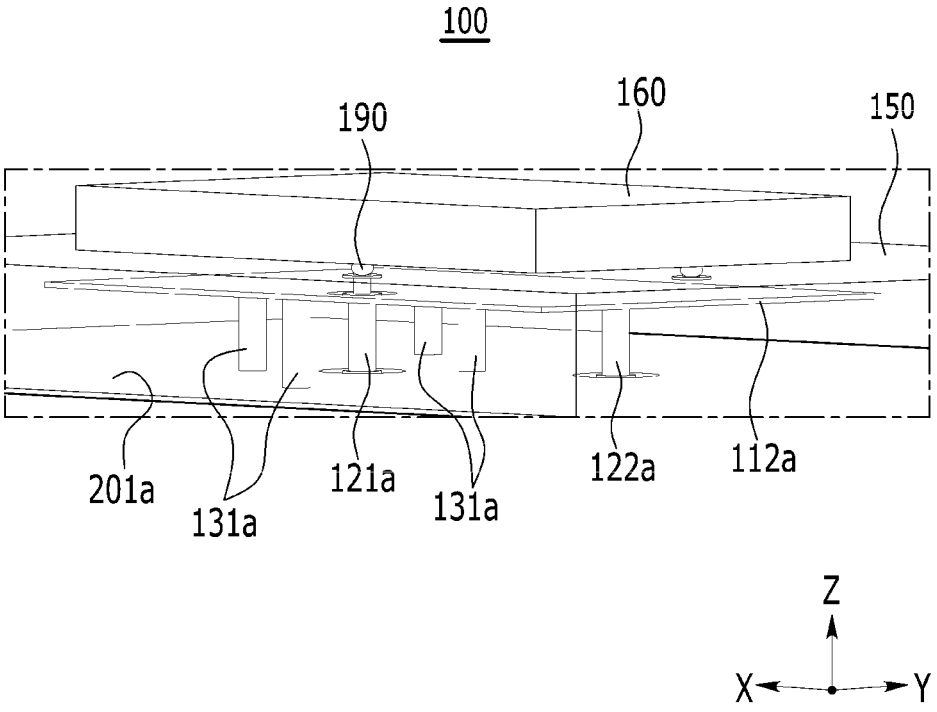
FIG. 5 and FIG. 6 are schematic perspective view and side view, respectively, of an antenna according to an embodiment.
Figure 6:
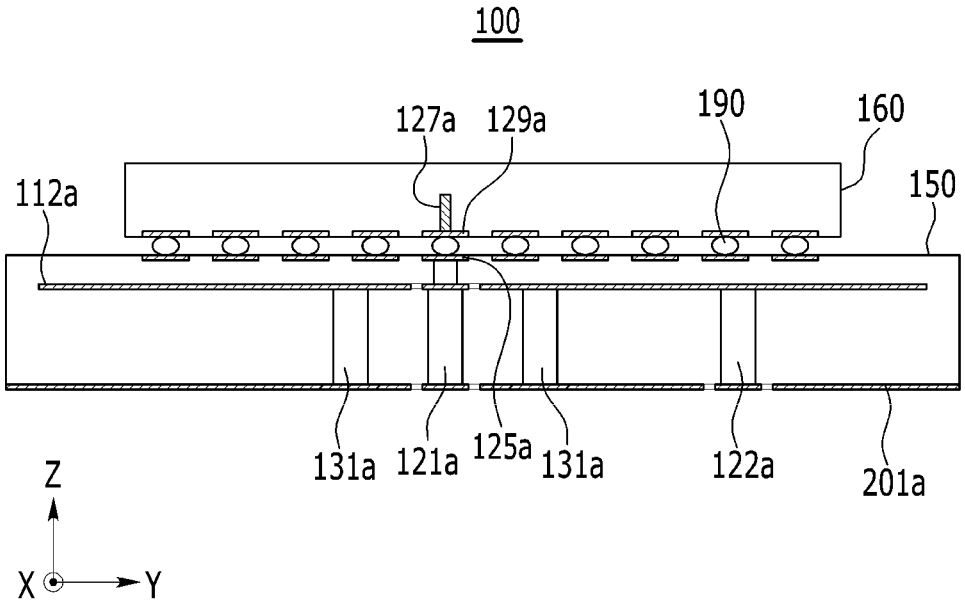

FIG. 5 and FIG. 6 are schematic perspective view and side view, respectively, of an antenna according to an embodiment.

Referring to FIG. 5 and FIG. 6, an antenna device 100 includes a dielectric resonator antenna 160, a patch antenna pattern 112*a*, a first feed via 121*a*, a second feed via 122*a*, and a plurality of shielding vias 131*a*. The antenna device 100 may selectively include a third feed via 127*a*, a ground plane 201*a*, and an electrical connection structure 190. Among the configurations of the antenna device 100 of FIG. 5 and FIG. 6, the above-stated description of the antenna device 100 of FIG. 1 and FIG. 2 is applied to the configurations overlapping with the antenna device 100 of FIG. 1 and FIG. 2.

The plurality of shielding vias 131*a* are disposed close to the first feed via 121*a*. For example, the plurality of shielding vias 131*a* may be arranged to surround the first feed via 121*a*. The plurality of shielding vias 131*a* may be arranged to connect between the patch antenna pattern 112*a* and the ground plane 201*a*. The plurality of shielding vias 131*a* may shield the first feed via 121*a* from a signal transmitted to or received from the patch antenna pattern 112*a*.

The first feed via 121*a* is disposed to penetrate the patch antenna pattern 112*a* and thus may be affected by radiation of the second RF signal concentrated in the patch antenna pattern 112*a*, and the plurality of shielding vias 131*a* reduce such an influence, thereby reducing deterioration of the gain of each of the dielectric resonator antenna 160 and the patch antenna pattern 112*a*.

A first RF signal radiated toward the second feed via 122*a* among the first RF signals radiated from the dielectric resonator antenna 160 may be reflected by the plurality of shielding vias 190, and thus electromagnetic isolation between the first RF signal and the second RF signal can be improved and the gain of each of the dielectric resonator antenna 160 and the patch antenna pattern 112*a* can be improved.

The number and width of the plurality of shielding vias 131*a* are not particularly limited. When a gap between the plurality of shielding vias 131*a* is shorter than a specific length (e.g., a length dependent on the first wavelength of the first RF signal or a length dependent on the second wavelength of the second RF signal), the first RF signal or the second RF signal may not be able to substantially pass through spaces between the plurality of shielding vias 131*a*. Accordingly, the degree of electromagnetic isolation between the first and second RF signals can be further improved.

Figure 7:
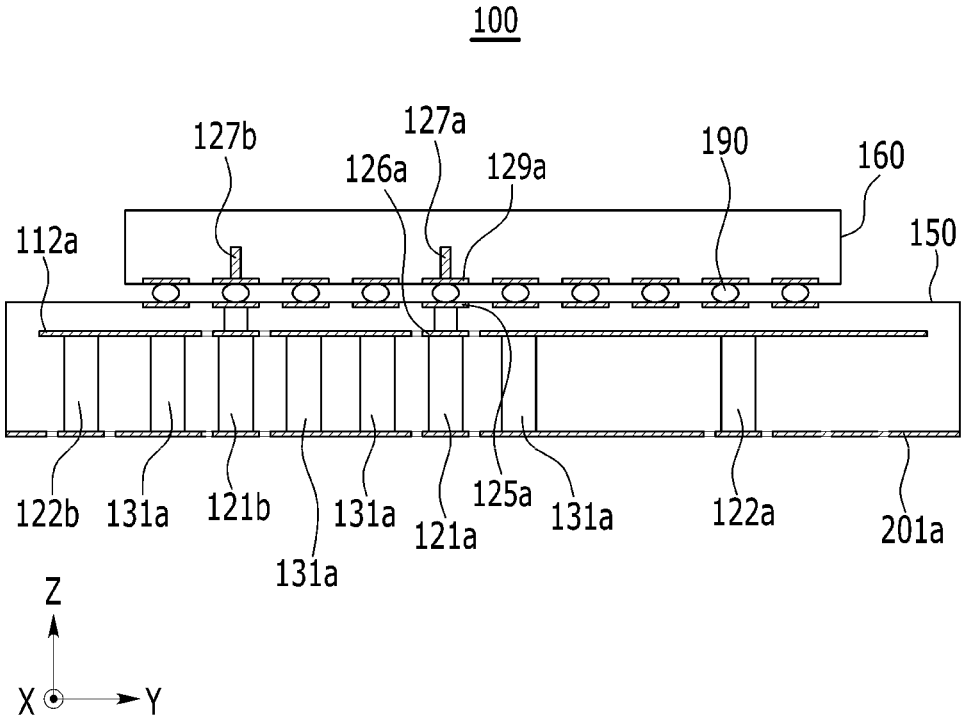
FIG. 7 and FIG. 8 are a side view and a top plan view, respectively, that schematically illustrate an antenna device according to an embodiment.
Figure 8:
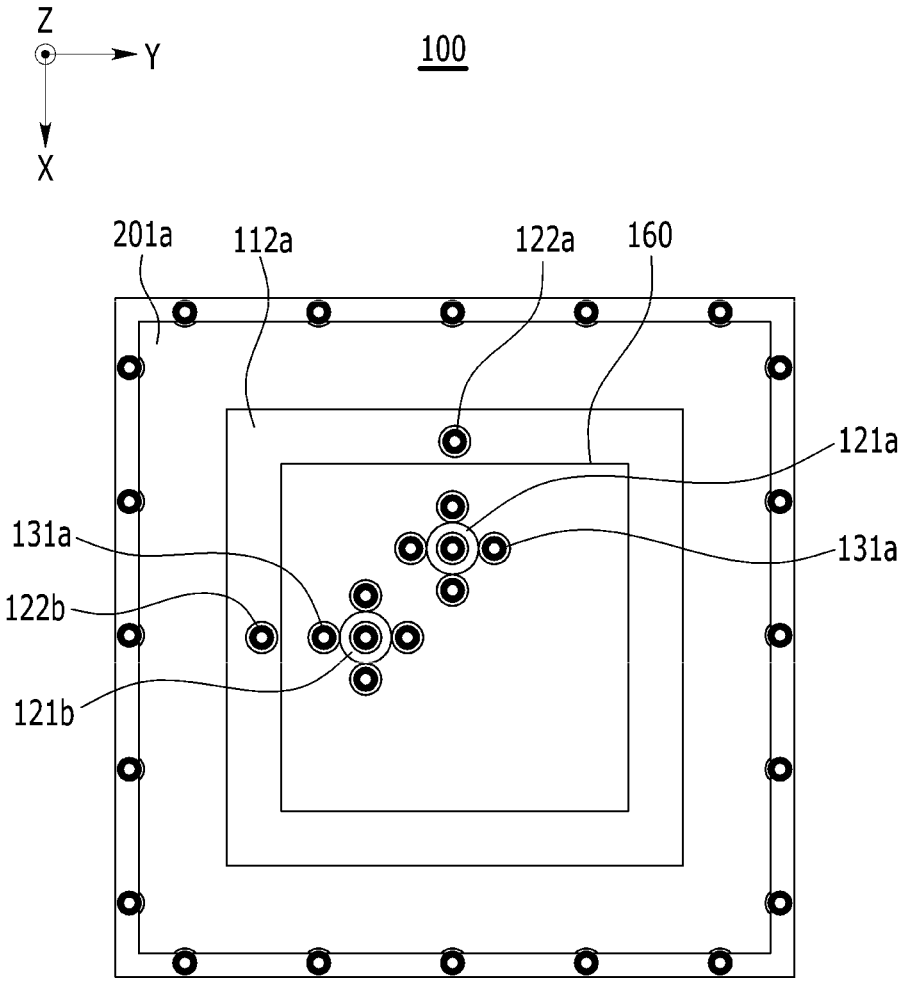

FIG. 7 and FIG. 8 are a side view and a top plan view, respectively, that schematically illustrate an antenna device according to an embodiment.

Referring to FIG. 7 and FIG. 8, an antenna device 100 includes a dielectric resonator antenna 160, a patch antenna pattern 112*a*, two first feed vias 121*a* and 121*b*, and two second feed vias 122*a* and 122*b*. The antenna device 100 may selectively include a plurality of shielding vias 131*a*, a third feed via 127*a*, a ground plane 201*a*, and an electrical connection structure 190. Among the configurations of the antenna device 100 of FIG. 7 and FIG. 8, the above-stated description of the antenna device 100 of FIG. 1 and FIG. 2 or the antenna device 100 of FIG. 5 and FIG. 6 is applied to the configurations overlapping with the antenna device 100 of FIG. 1 and FIG. 2 or the antenna device 100 of FIG. 5 and FIG. 6.

The two first feed vias 121*a* and 121*b* may each transmit and receive a plurality of polarized waves, each having a different phase. The two second feed vias 122*a* and 122*b* may each also transmit and receive a plurality of polarized waves, each having a different phase.

The first feed vias 121*a* and 121*b* may allow a 1-1 RF signal and a 1-2 RF signal, which are polarized to each other, to pass. The second feed vias 122*a* and 122*b* may allow a 2-1 RF signal and a 2-2 RF signal, which are polarized to each other, to pass.

Each of the dielectric resonator antenna 160 and patch antenna pattern 112*a* may transmit a plurality of RF signals, and the plurality of RF signals may be a plurality of carrier signals carrying different data. Accordingly, a data transmitting or receiving rate of each of the dielectric resonator antenna 160 and the patch antenna pattern 112*a* may be improved by two times according to the transmitting or receiving of the plurality of RF signals.

For example, the 1-1 RF signal and the 1-2 RF signal have different phases (e.g., a 90 degree or 180 degree phase difference) such that interference with each other can be reduced, and the 2-1 RF signal and the 2-2 RF signal have different phases (e.g., a 90 degree or 180 degree phase difference) such that interference with each other can be reduced.

For example, the 1-1 RF signal and the 2-1 RF signal respectively form an electric field and a magnetic field with respect to the x-axis direction and the y-axis direction that are perpendicular to the propagation direction (e.g., the z-axis direction), while being perpendicular to each other, thereby implementing polarization between RF signals. Surface currents corresponding to the 1-1 RF signal and the 2-1

RF signal and surface currents corresponding to the 1-2 RF signal and the 2-2 RF signal in the dielectric resonator antenna 160 and the patch antenna pattern 112*a* may flow to be perpendicular to each other. Here, the x-axis direction and the y-axis direction match directions indicated by sides that are perpendicular to each other in the patch antenna pattern 112*a*, and the z-axis direction matches a normal direction for the patch antenna pattern 112*a*.

Figure 9:
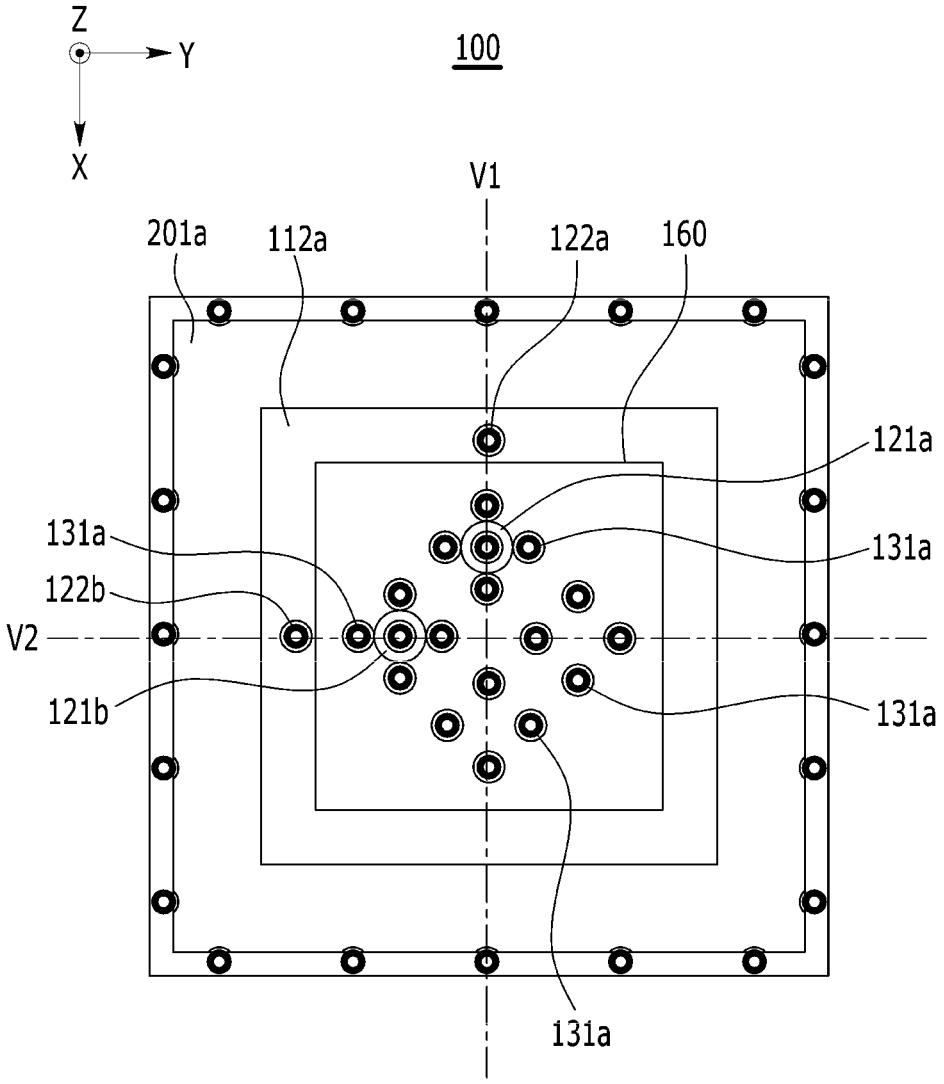
FIG. 9 is a top plan view that schematically illustrates an antenna device according to an embodiment.

FIG. 9 is a top plan view that schematically illustrates an antenna device according to an embodiment.

Referring to FIG. 9, an antenna device 100 includes a dielectric resonator antenna 160, a patch antenna pattern 112*a*, two first feed vias 121*a* and 121*b*, and two second feed vias 122*a* and 122*b*. The antenna device 100 may selectively include a plurality of shielding vias 131*a*, a third feed via 127*a*, a ground plane 201*a*, and an electrical connection structure 190. Among the configurations of the antenna device 100 of FIG. 9, the above-stated description of the antenna device 100 of FIG. 1 and FIG. 2, the antenna device 100 of FIG. 5 and FIG. 6, or the antenna device 100 of FIG. 7 and FIG. 8 is applied to the configurations overlapping with the antenna device 100 of FIG. 1 and FIG. 2, the antenna device 100 of FIG. 5 and FIG. 6, or the antenna device 100 of FIG. 7 and FIG. 8.

The plurality of shielding vias 131*a* may be arranged symmetrical to each other. For example, the plurality of shielding vias 131*a* are arranged horizontally symmetrical to each other with reference to a virtual first extension line V1 that connects the first feed via 121*a* and the second feed via 122*a*, and are also arranged horizontally symmetrical to each other with reference to a virtual second extension line V2 that connects the first feed via 121*b* and the second feed via 122*b*.

Compared to the asymmetrical arrangement structure of the plurality of shielding vias shown in FIG. 8, when the plurality of shielding vias 131*a* are arranged symmetrical to each other, a peak gain is shifted toward the boresight in the radiation pattern such that a difference between the peak gain and the gain at the boresight may be reduced. In addition, in case of the symmetric arrangement structure of the plurality of shielding vias, in electromagnetic field distribution, the amount of current induced in the antenna device 100 may be more uniform than the asymmetric arrangement structure of the plurality of shielding vias, and the magnitude of a fringing field may be larger in the antenna device 100 having the symmetric arrangement structure of the plurality of shielding vias. Accordingly, beam tilting in the antenna device 100 having the symmetric arrangement structure of the plurality of shielding vias may be alleviated, a gain at boresight may be improved, and a uniform gain may be formed within a bandwidth.

Figure 10:
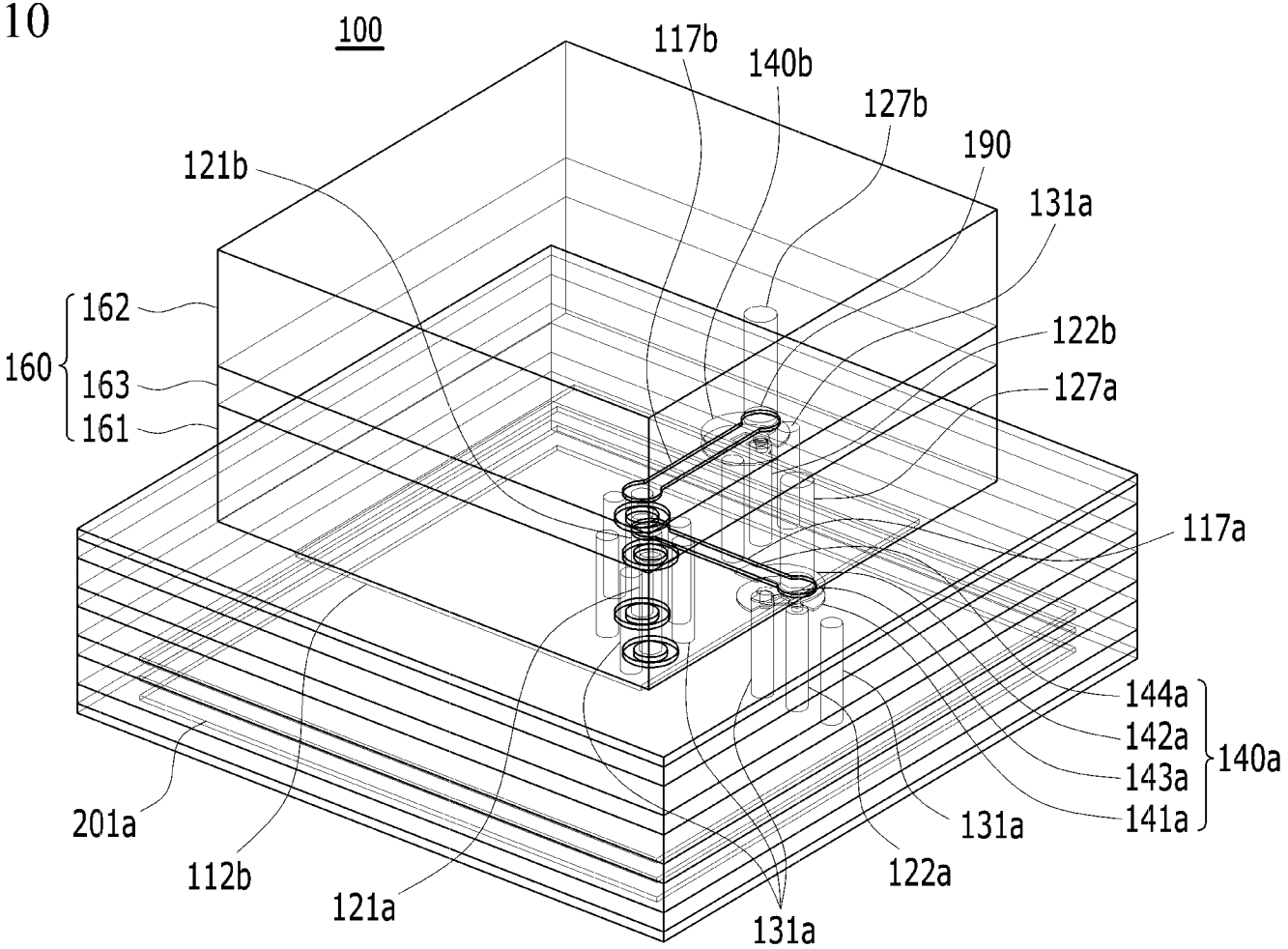
FIG. 10 is a perspective view that schematically illustrates an antenna device according to an embodiment.

FIG. 10 is a perspective view that schematically illustrates an antenna device according to an embodiment.

Referring to FIG. 10, an antenna device 100 includes a dielectric resonator antenna 160, a patch antenna pattern 112*a*, two first feed vias 121*a* and 121*b*, two second feed vias 122*a* and 122*b*, and two winding feed patterns 140*a* and 140*b*. The antenna device 100 may selectively include a plurality of shielding vias 131*a*, two third feed vias 127*a* and 127*b*, two strip patterns 117*a* and 117*b*, a ground plane 201*a*, and an electrical connection structure 190. Among the configurations of the antenna device 100 of FIG. 10, the above-stated description of the antenna device 100 of FIG. 1 to FIG. 9 is applied to the configurations overlapping with the antenna device 100 of FIG. 1 to FIG. 9.

The winding feed patterns 140*a* and 140*b* are respectively electrically connected to upper ends of the second feed vias 122*a* and 122*b*, and are separated from the patch antenna pattern 112*a*. Since the winding feed patterns 140*a* and 140*b* may be disposed in spaces formed due to separation of the second feed vias 122*a* and 122*b* and the patch antenna pattern 112*a*, design freedom of the winding feed patterns 140*a* and 140*b* can be improved.

At least some of each of the winding feed patterns 140*a* and 140*b* have a winding form. For example, each of the winding feed patterns 140*a* and 140*b* may include at least one of a first winding feed pattern 141*a*, a second winding feed pattern 142*a*, and a winding via 143*a*, and the second winding feed pattern 142*a* may include an extension part 144*a*.

Each of the winding feed patterns 140*a* and 140*b* provides a feeding path to the patch antenna pattern 112*a* by electromagnetic coupling with respect to the patch antenna pattern 112*a*. Since the winding feed patterns 140*a* and 140*b* can be used as a feeding path, a winding current corresponding to an RF signal transmitted through each of the winding feed patterns 140*a* and 140*b* may flow through the winding feed patterns 140*a* and 140*b*. A direction of the winding current may rotate corresponding to the winding shape of the winding feed patterns 140*a* and 140*b*. Accordingly, self-inductance of the winding feed patterns 140*a* and 140*b* may be boosted such that the winding feed patterns 140*a* and 140*b* may have relatively high inductance. Each of the winding feed patterns 140*a* and 140*b* can provide the inductance to the patch antenna pattern 112*a*, and thus, the patch antenna pattern 112*a* may have a wider bandwidth based on an additional resonance frequency that corresponds to the inductance.

At least part of each of the winding feed patterns 140*a* and 140*b* may have a shape extending in a plurality of directions from one end of the winding shape. The winding feed patterns 140*a* and 140*b* may respectively include extension parts 144*a*. As the number of extension directions in the extension part 144*a* increases or the angle between the extension directions in the extension part 144*a* increases, energy corresponding to the RF signal in each of the winding feed patterns 140*a* and 140*b* may be more concentrated in the extension part 144*a*.

Since each of the winding feed patterns 140*a* and 140*b* includes the extension part 144*a*, the patch antenna pattern 112*a* may use the extension part 144*a* as a relay point for impedance matching of the feeding path. Accordingly, the extension part 144*a* can further improve impedance matching efficiency of the feeding path with respect to the patch antenna pattern 112*a*. In addition, since electromagnetic coupling concentration for the patch antenna pattern 112*a* of the winding feed patterns 140*a* and 140*b* can be increased in the antenna device 100, the gain of the patch antenna pattern 112*a* can be further improved.

The third feed vias 127*a* and 127*b* respectively connect the first feed vias 121*a* and 121*b* and the dielectric resonator antenna 160, and are inserted into the dielectric resonator antenna 160. In addition, the third feed vias 127*a* and 127*b* may be respectively disposed at an outer surface of the dielectric resonator antenna 160. The dielectric resonator antenna 160 may be fed through the first feed vias 121*a* and 121*b* and the third feed vias 127*a* and 127*b*, and accordingly, feeding efficiency can be improved.

The strip patterns 117*a* and 117*b* respectively extend in a direction that is away from the first feed vias 121*a* and 121*b*, and the first feed vias 121*a* and 121*b* and the third feed vias 127*a* and 127*b* are electrically connected to each other through the strip patterns 117*a* and 117*b*. Each of the strip patterns 117*a* and 117*b* may have a plane parallel to the plane of the patch antenna pattern 112*a*. An electrical length of a feeding path for the dielectric resonator antenna 160 can be adjusted through the strip patterns 117*a* and 117*b*, and accordingly, impedance matching freedom can be improved, and the gain of the antenna device 100 can be improved.

Figure 11:
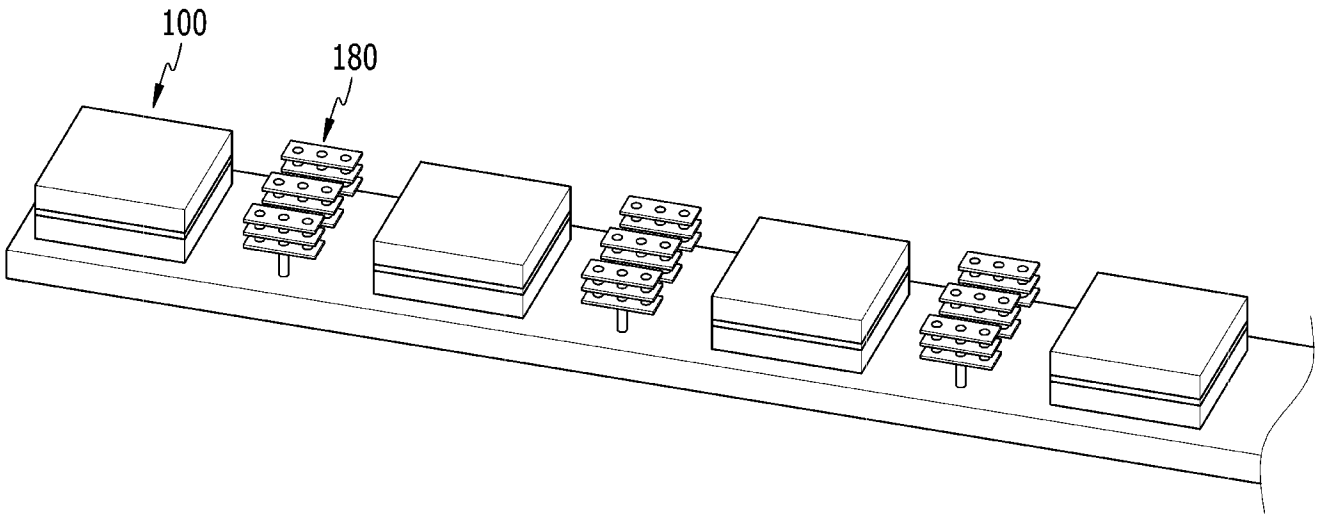
FIG. 11 is a top perspective view of an arrangement of a plurality of antenna devices according to an embodiment.

FIG. 11 is a top perspective view of an arrangement of a plurality of antenna devices according to an embodiment.

An antenna array includes a plurality of antenna devices 100. Each of the plurality of antenna devices 100 may be one of the above-described antenna devices of FIG. 1 to FIG. 10. When such an antenna array is used for 5G millimeter wave communication, the antenna array may have a high and uniform gain for a signal having a quadruple bandwidth among 5G frequency bandwidths while having a small size.

A plurality of shielding structures 180 may be selectively disposed between the plurality of antenna devices 100 to block the plurality of antenna devices 100. The plurality of shielding structures 180 may prevent interference between the plurality of antenna devices 100, and thus the gain of the antenna array may be increased.

Figure 12:
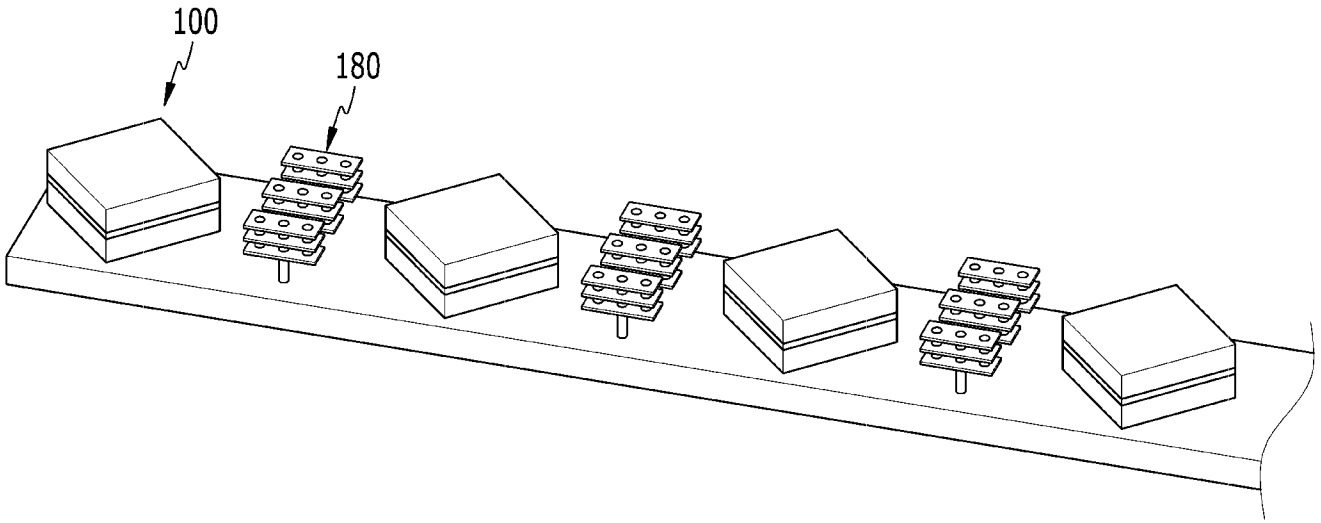
FIG. 12 is a top perspective view of an arrangement of a plurality of antenna devices according to an embodiment.

FIG. 12 is a top perspective view of an arrangement of a plurality of antenna devices according to an embodiment.

An antenna array includes a plurality of antenna devices 100. Each of the plurality of antenna devices 100 may be one of the above-described antenna devices of FIG. 1 to FIG. 10. When such an antenna array is used for 5G millimeter wave communication, the antenna array may have a high and uniform gain for a signal having a quadruple bandwidth among 5G frequency bandwidths while having a small size.

At least one side of each of the plurality of antenna devices 100 is slanted at a certain angle with respect to one side of a substrate on which the plurality of antenna devices 100 are mounted in a planar view. For example, in the antenna device 100, at least one side of a patch antenna pattern 112*a* or at least one side of a dielectric resonator antenna 160 is slanted in a plan view. Since the plurality of patch antenna patterns 112*a* are arranged to not be parallel to each other between the plurality of slanted antenna devices 100, the coupling between the plurality of patch antenna patterns 112*a* may be weakened. In addition, since dielectric resonator antennas 160 are arranged to not be parallel to each other, the coupling between the plurality of dielectric resonator antennas 160 may be weakened. Accordingly, a gain loss of the antenna device 100 may occur due to the coupling between the plurality of antenna devices 100, and the gain loss may be reduced between the plurality of slanted antenna devices 100.

A plurality of shielding structures 180 may be selectively disposed between the plurality of antenna devices 100 to block the plurality of antenna devices 100. The plurality of shielding structures 180 may prevent interference between the plurality of antenna devices 100, and thus the gain of the antenna array may be increased.

Figure 13:
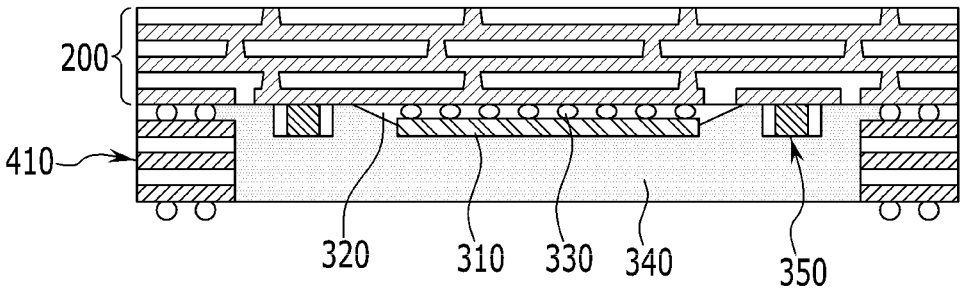
FIG. 13 is a side view that schematically illustrates a lower side structure of an antenna device according to an embodiment.

FIG. 13 is a side view that schematically illustrates a lower side structure of an antenna device according to an embodiment.

Referring to FIG. 13, an antenna device according to an embodiment includes at least a part of a connection member 200, an IC 310, an adhesive member 320, an electrical connection structure 330, an encapsulation member 340, a manual part 350, and a core member 410.

The connection member 200 may have a structure in which a plurality of metal layers having a pre-designed pattern such as a printed circuit board (PCB), and a plurality of insulation layers are stacked.

The IC 310 may be disposed in a lower side of the connection member 200. The IC 310 is connected to a wire of the connection member 200 and thus may transmit or receive an RF signal, and may receive a ground by being connected to a ground plane of the connection member 200. For example, the IC 310 may generate a converted signal by performing at least some of frequency conversion, amplification, filtering, phase control, and power generation.

The adhesive member 320 may bond the IC 310 and the connection member 200 to each other.

The electrical connection structure 330 may connect the IC 310 and the connection member 200. For example, the electrical connection structure 330 may have a structure such as a solder ball, a pin, a land, and a pad. The electrical connection structure 330 has a lower melting point than the wiring of the connection member 200 and the ground plane, and thus the IC 310 and the connection member 200 can be connected through a predetermined process using such a lower melting point.

The encapsulation member 340 may encapsulate at least a part of the IC 310, and may improve heat dissipation performance and impact protection performance of the IC 310. For example, the encapsulation member 340 may be implemented as a photoimageable encapsulant (PIE), an Ajinomoto build-up film (ABF), an epoxy molding compound (EMC), and the like.

The manual part 350 may be disposed on the bottom surface of the connection member 200, and may be connected to the wire of the connection member 200 and/or a ground plane. For example, the manual part 350 may include at least some of a capacitor (e.g., a multi-layer ceramic capacitor (MLCC)), an inductor, and a chip resistor.

The core member 410 may be disposed in a lower side of the connection member 200, and may be connected to the connection member 200 so as to receive an intermediate frequency (IF) signal or a baseband signal from the outside and transmit the received signal to the IC 310, or to receive an IF signal or a baseband signal from the IC 310 and transmit the received signal to the outside. Here, a frequency (e.g., 24 GHz, 28 GHz, 36 GHz, 39 GHz, or 60 GHz) of the RF signal is higher than a frequency (e.g., 2 GHz, 5 GHz, 10 GHz, and the like) of the IF signal.

For example, the core member 410 may transmit an IF signal or a baseband signal to the IC 310 or receive it from the IC 310 through a wire that can be included in the IC ground plane of the connection member 200. Since the ground plane of the connection member 200 is disposed between the IC ground plane and the wire, the IF signal or baseband signal and the RF signal can be electrically separated from each other in the antenna device.

Figure 14:
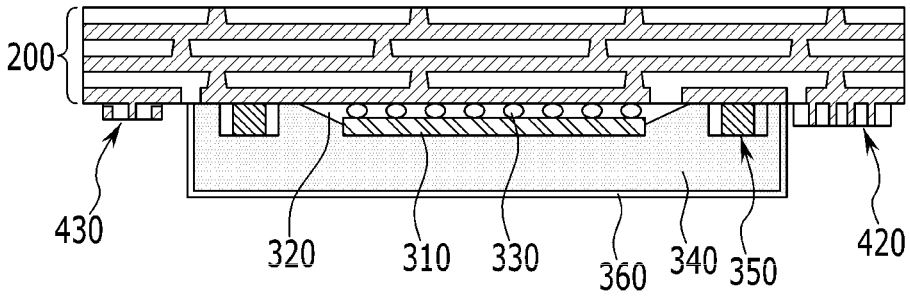
FIG. 14 is a side view that schematically illustrates a lower side structure of an antenna device according to an embodiment.

FIG. 14 is a side view that schematically illustrates a lower side structure of an antenna device according to an embodiment.

Referring to FIG. 14, an antenna device according to an embodiment may include at least some of a shield member 360, a connector 420, and a chip antenna 430.

The shield member 360 is disposed in a lower side of the connection member 200 to confine the IC 310 and the encapsulation member 340 along with the connection member 200. For example, the shield member 360 may be disposed for conformal shielding of all the IC 310, the manual part 350, and the encapsulation member 340 or compartment shielding of each of the IC 310, the manual part 350, and the encapsulation member 340. For example, the shield member 360 has a shape of a hexahedron with one open side, and may have a hexahedral receiving space for combination with the connection member 200. The shield member 360 may have a short skin depth because it is implemented with a material with high conductivity, such as copper, and may be connected to a ground plane of the connection member 200. Therefore, the shield member 360 can reduce electromagnetic noise that the IC 310 and the manual part 350 may receive. However, the encapsulation member 340 may be omitted depending on the design.

The connector 420 may have a connection structure of a cable (e.g., a coaxial cable, a flexible PCB, and the like), may be connected to the IC ground plane of the connection member 200, and may play a similar role to a sub-board. The connector 420 may receive an IF signal, a baseband signal, and/or power from a cable, or may provide an IF signal and/or a baseband signal through a cable.

The chip antenna 430 may transmit or receive an RF signal in support of the antenna device according to the embodiment. For example, the chip antenna 430 may include a dielectric block having a larger dielectric constant than an insulation layer, and a plurality of electrodes disposed at opposite sides of the dielectric block. One of the plurality of electrodes may be connected to a wire of the connection member 200, and the other may be connected to the ground plane of the connection member 200.

Figure 15:
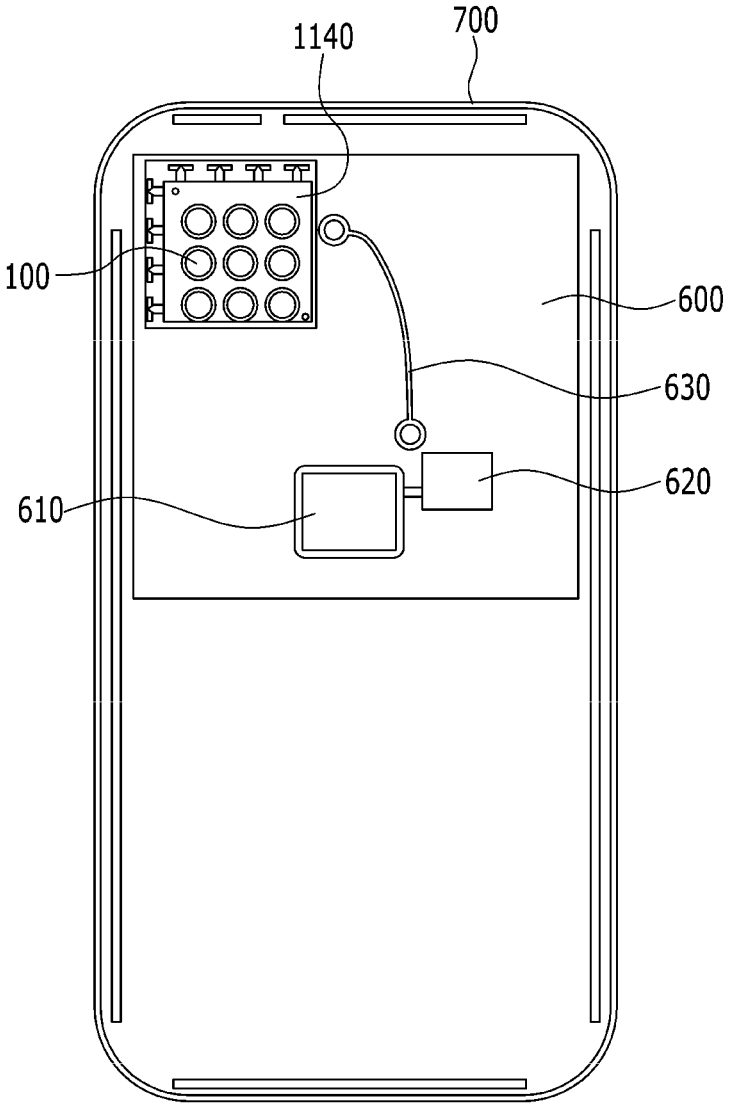
FIG. 15 is a top plan view that illustrates an arrangement of antenna devices in an electronic device according to an embodiment.

FIG. 15 is a top plan view that illustrates an arrangement of antenna devices in an electronic device according to an embodiment.

Referring to FIG. 15, one or more antenna devices 100 may be arranged adjacent to side boundaries of an electronic device 700 on a set substrate 600 of the electronic device 700. The one or more antenna devices 100 may be one or more of the above-described antenna devices of FIG. 1 to FIG. 14.

The electronic device 700 may be a smart phone, a personal digital assistant, a digital video camera, a digital still camera, a network system, a computer, a monitor, a tablet, a laptop, a netbook, a television, a video game, a smart watch, an automotive part, and the like, but this is not restrictive.

A communication module 610 and a baseband circuit 620 may be further disposed on the set substrate 600. The one or more antenna devices 100 may be connected to the communication module 610 and/or the baseband circuit 620 through a coaxial cable 630.

The communication module 610 may include: a memory chip such as a volatile memory (e.g., DRAM), a non-volatile memory (e.g., ROM), and a flash memory to perform digital signal processing; an application processor chip such as a central processor (e.g., CPU), a graphics processor (e.g., GPU), a digital signal processor, an encryption processor, a microprocessor, and a microcontroller; and a logic chip such as an analog-digital converter and an application-specific IC (ASIC).

The baseband circuit 620 may generate a base signal by performing analog-digital conversion, amplification of an analog signal, filtering, and frequency conversion. The base signal input or output from the baseband circuit 620 may be transmitted to the antenna device through a cable.

For example, the base signal may be transmitted to the IC through electrical connection structures, core vias, and wiring. The IC can convert the base signal into a millimeter wave (mmWave) band RF signal.

A dielectric layer 1140 may be filled in a region in which patterns, vias, planes, lines, and electrical connection structures are not disposed in the antenna device according to the embodiment.

Figure 16:
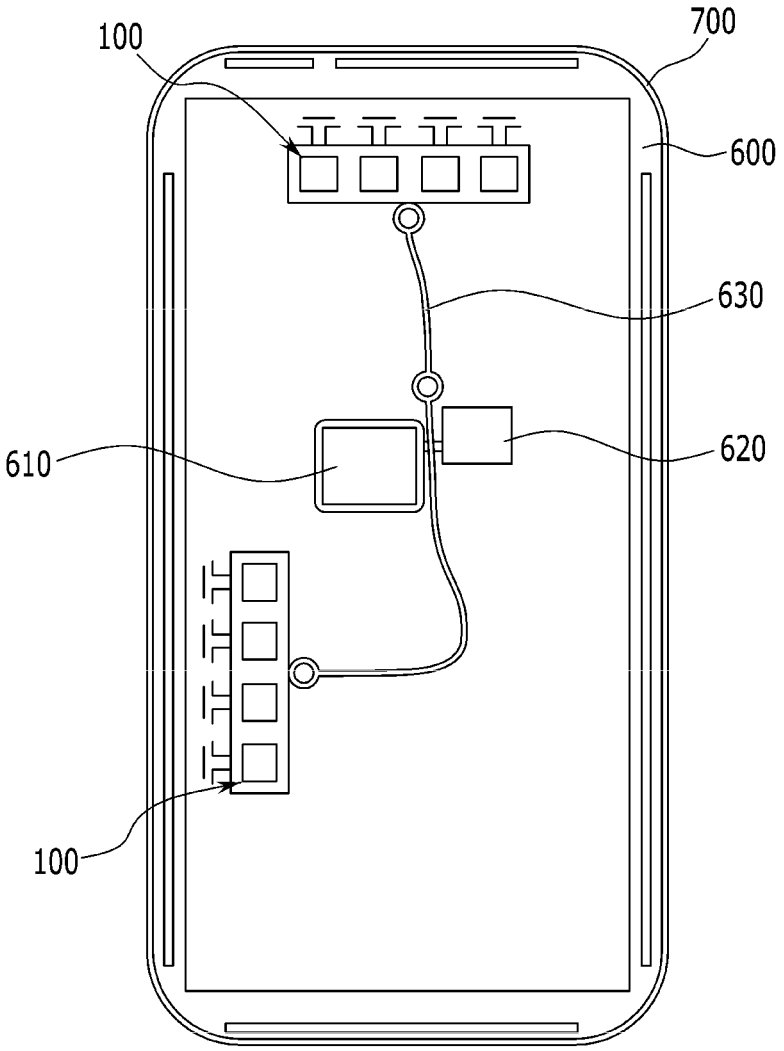
FIG. 16 is a top plan view that shows an arrangement of antenna devices in an electronic device according to an embodiment.

FIG. 16 is a top plan view that shows an arrangement of antenna devices in an electronic device according to an embodiment.

Referring to FIG. 16, antenna devices 100 may be disposed adjacent to the center of each side of a polygonal electronic device 700 on a set substrate 600 of an electronic device 700, and a communication module 610 and a baseband circuit 620 may be further disposed on the set substrate 600. The antenna devices 100 may be connected to the communication module 610 and/or the baseband circuit 620 through a coaxial cable 630. The antenna devices 100 may be one or more of the above-described antenna devices of FIG. 1 to FIG. 14.

Figure 17:
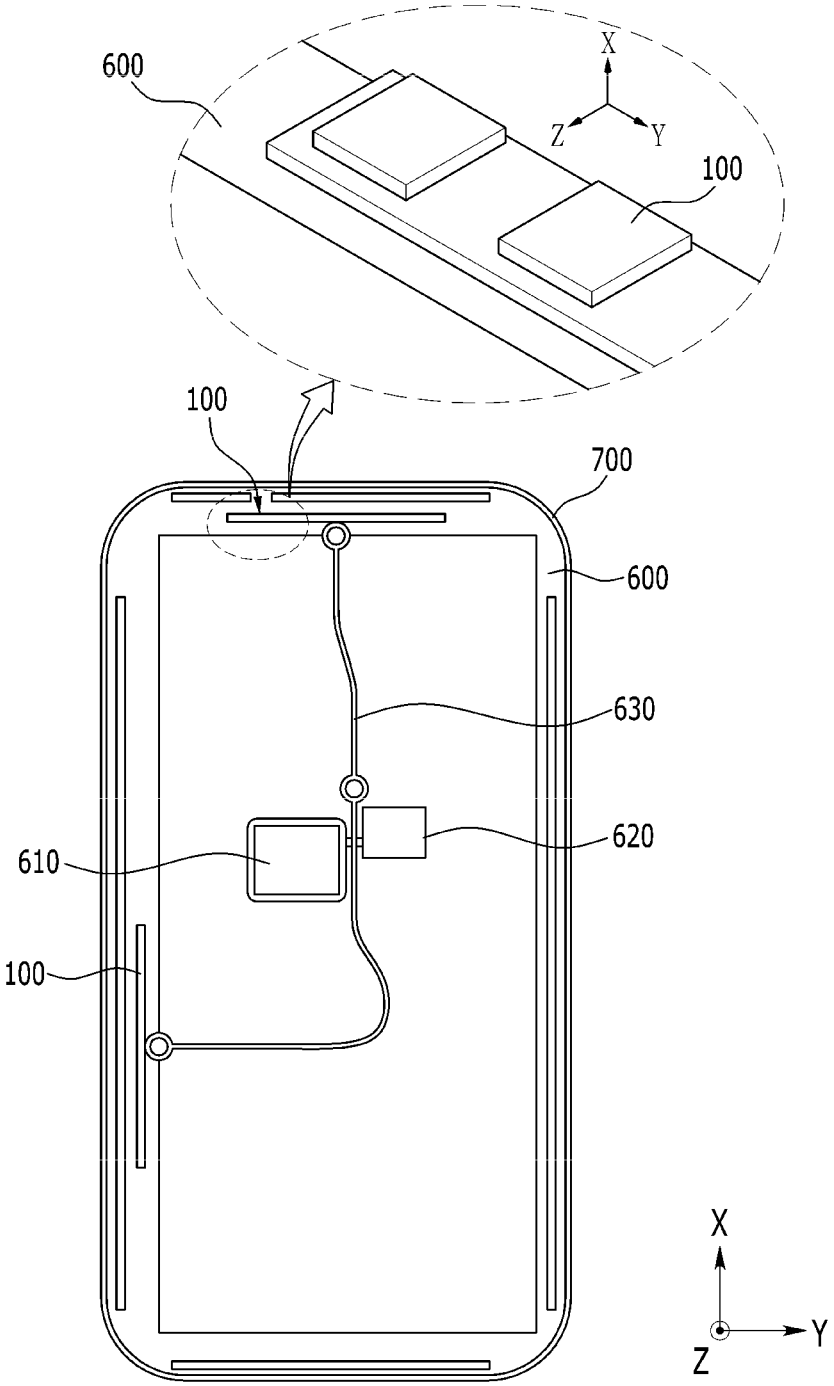
FIG. 17 is a top plan view that shows an arrangement of antenna devices in an electronic device and a top perspective enlargement of antenna devices according to an embodiment.

FIG. 17 is a top plan view that shows an arrangement of antenna devices in an electronic device and a top perspective enlargement of antenna devices according to an embodiment.

Referring to FIG. 17, antenna devices 100 may be disposed vertically on a side of a polygonal electronic device 700 on a set substrate 600 of an electronic device 700. For example, a boresight direction of an antenna device 100 disposed in an upper side of the electronic device 700 may be an X-axis direction, and a boresight direction of an antenna device 100 disposed on the left side of the electronic device 700 may be a Y-axis direction that becomes away (faces outward) from the electronic device 700. A communication module 610 and a baseband circuit 620 may be further disposed on the set substrate 600. The antenna devices 100 may be connected to the communication module 610 and/or the baseband circuit 620 through a coaxial cable 630. The antenna devices 100 may be one or more of the above-described antenna devices of FIG. 1 to FIG. 14.

According to example embodiments disclosed herein, an antenna device may be easily down-sized while providing transmitting or receiving for a plurality of different frequency bandwidths.

According to example embodiments disclosed herein, gain of an antenna may be improved while assuring a wide bandwidth.

According to example embodiments disclosed herein, gains of a plurality of frequency bandwidths that are different from each other may be improved by improving the degree of isolation between the plurality of different frequency bandwidths.

While specific example embodiments have been shown and described above, it will be apparent after an understanding of this disclosure that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna device comprising:

a dielectric resonator antenna configured to transmit and/or receive a first RF signal;

a patch antenna pattern configured to transmit and/or receive a second RF signal, and at least partially overlaps the dielectric resonator antenna in a vertical direction;

a feed via comprising a first feed via configured to feed to the dielectric resonator antenna; and a second feed via configured to feed to the patch antenna pattern, wherein a frequency of the first RF signal is lower than a frequency of the second RF signal, and wherein a dielectric block of the dielectric resonator antenna overlaps the feed via in the vertical direction.

2. The antenna device of claim 1, wherein a dielectric constant of the dielectric resonator antenna is higher than a dielectric constant of a dielectric layer where the patch antenna pattern is implemented.

3. The antenna device of claim 2, wherein the feed via further comprises a third feed via electrically connecting the first feed via to the dielectric resonator antenna.

4. The antenna device of claim 1, wherein the dielectric resonator antenna comprises a first dielectric block, a polymer layer disposed on the first dielectric block, and a second dielectric block disposed on the polymer layer.

5. The antenna device of claim 4, wherein the feed via further comprises a third feed via electrically connecting the first feed via to the dielectric resonator antenna.

6. The antenna device of claim 5, further comprising a metal patch disposed on the top surface of the first dielectric block, wherein the metal patch is electrically connected with the third feed via.

7. The antenna device of claim 1, further comprising a strip pattern electrically connected with the first feed via, wherein the strip pattern extends in a direction that is away from the first feed via.

8. The antenna device of claim 1, further comprising a plurality of shielding vias coupled to the patch antenna pattern, wherein the plurality of shielding vias are located close to the first feed via.

9. The antenna device of claim 8, wherein the plurality of shielding vias are configured to shield the first feed via from a signal transmitted to or received from the patch antenna pattern.

10. The antenna device of claim 1, wherein the first feed via comprises a 1-1 feed via configured to feed a 1-1 RF signal and a 1-2 feed via configured to feed a 1-2 RF signal, and wherein the 1-1 RF signal and the 1-2 RF signal are polarized to each other.

11. The antenna device of claim 10, wherein the second feed via comprises a 2-1 feed via configured to feed a 2-1 RF signal and a 2-2 feed via configured to feed a 2-2 RF signal, and wherein the 2-1 RF signal and the 2-2 RF signal are polarized to each other.

12. The antenna device of claim 1, further comprising a winding feed pattern electrically connected to an upper end of the second feed via, wherein the winding feed pattern is at least partially formed in a winding shape.

13. The antenna device of claim 12, wherein the winding feed pattern comprises an extension part extended from an end of the winding feed pattern.

14. An antenna array comprising:

a plurality of antenna devices comprising the antenna device of claim 1; and a shielding structure disposed between adjacent ones of the plurality of antenna devices.

15. An electronic device comprising:

the antenna device of claim 1.

16. An antenna device comprising:

a dielectric layer having a first dielectric constant;

a patch antenna pattern disposed in the dielectric layer;

a dielectric resonator antenna disposed on the patch antenna pattern, the dielectric resonator antenna having a second dielectric constant;

a first feed via coupled to the dielectric resonator antenna; and a second feed via coupled to the patch antenna pattern, wherein the second dielectric constant is higher than the first dielectric constant, and wherein a dielectric block of the dielectric resonator antenna overlaps the first feed via in a vertical direction.

17. The antenna device of claim 16, wherein the dielectric resonator antenna comprises a first dielectric block, a polymer layer disposed on the first dielectric block, and a second dielectric block disposed on the polymer layer.

18. The antenna device of claim 16, wherein the patch antenna pattern at least partially overlaps the dielectric resonator antenna in the vertical direction.

19. An antenna array comprising:

two or more antenna devices comprising the antenna device of claim 16; and a shielding structure disposed between adjacent ones of the two or more antenna devices.

20. An electronic device comprising:

a polygonal housing; and two or more antenna devices comprising the antenna device of claim 16 disposed adjacent to the center of each side of the polygonal housing.

21. An antenna device comprising:

a patch antenna pattern disposed in a dielectric layer having a first dielectric constant;

a dielectric resonator antenna having a second dielectric constant and disposed on the patch antenna pattern;

a first feed via coupled to the dielectric resonator antenna and extending through the patch antenna pattern; and a second feed via coupled to the patch antenna pattern, wherein a dielectric block of the dielectric resonator antenna overlaps the first feed via in a plan view.

22. The antenna device of claim 21, wherein the dielectric resonator antenna and the patch antenna pattern overlap in a plan view.

23. The antenna device of claim 21, wherein the second dielectric constant is higher than the first dielectric constant.

24. The antenna device of claim 21, further comprising a ground layer disposed on an opposite side of the patch antenna pattern from the dielectric resonator antenna, and an integrated circuit (IC) disposed on an opposite side of the ground layer from the patch antenna pattern, wherein the IC is configured to transmit and receive a first RF signal to and from the first feed via and a second RF signal, having a higher frequency than the first RF signal, to and from the second feed via.

25. An antenna array comprising:

two or more antenna devices comprising the antenna device of claim 21.

26. The antenna array of claim 25, further comprising a shielding structure disposed between adjacent ones of the two or more antenna devices.

27. An electronic device comprising:

the antenna device of claim 21.

28. An antenna device comprising:

a dielectric layer having a first dielectric constant;

a patch antenna pattern disposed in the dielectric layer;

a dielectric resonator antenna disposed on the patch antenna pattern, the dielectric resonator antenna having a second dielectric constant;

a first feed via coupled to the dielectric resonator antenna; and a second feed via coupled to the patch antenna pattern, wherein the dielectric resonator antenna comprises a first dielectric block, a polymer layer disposed on the first dielectric block, and a second dielectric block disposed on the polymer layer.

* * * * *